US005281953A

United States Patent [19]

Torres et al.

[11] Patent Number: 5,281,953

[45] Date of Patent: Jan. 25, 1994

[54] HEAT SENSITIVE PURSE ALARM

[76] Inventors: Carlos E. Torres; Evelyn A. Mundo-Torres, both of 113-14 72 Dr. Apt. AA Supre, Forest Hills, N.Y. 11375

[21] Appl. No.: 910,581

[22] Filed: Jul. 8, 1992

[51] Int. Cl.[5] ..... G08B 13/18

[52] U.S. Cl. ..... 340/571; 340/567; 340/600

[58] Field of Search ..... 340/571, 567, 600; 150/101, 102

[56] References Cited

U.S. PATENT DOCUMENTS 4,067,290 1/1978 Hartley ..... 150/102
4,195,234 3/1980 Berman ..... 340/567
4,394,644 7/1983 DiLeo et al. ..... 340/542
4,617,558 10/1986 Gin ..... 340/571
4,885,570 12/1989 Chien ..... 340/540
5,027,105 6/1991 Dailey et al. ..... 340/571

*Primary Examiner*—Glen R. Swann, III
*Attorney, Agent, or Firm*—Leon Gilden

[57] ABSTRACT

A purse alarm includes a unitary housing mounted within the purse having a heat sensor to activate a latching circuit, whereupon sensing of heat such as by an unauthorized individual within the purse cavity effects actuation of an alarm to direct a tone generator to effect audible alarm through an associated speaker of the housing.

1 Claim, 4 Drawing Sheets

HEAT SENSITIVE PURSE ALARM

BACKGROUND OF THE INVENTION

1. Field of the Invention

The field of invention relates to purse alarm structure, and more particularly pertains to a new and improved purse alarm wherein the same is operative through a heat activated sensor switch.

2. Description of the Prior Art

Purse alarms of various types are utilized throughout the prior art and typically are arranged to include mechanical switch actuation, such as exemplified in the U.S. Pat. Nos. 4,394,644; 4,885,570; 4,067,290; and 4,617,558.

Accordingly, the instant invention addresses a need not set forth in the prior art to utilize a heat activated thermo sensor to detect intrusion of unauthorized individuals into an associated purse and in this respect, the present invention substantially fulfills this need.

SUMMARY OF THE INVENTION

In view of the disadvantages inherent in the known types of purse alarm apparatus now present in the prior art, the present invention provides a purse alarm wherein the same is arranged to include a heat activated switching organization. As such, the general purpose of the present invention, which will be described subsequently in greater detail, is to provide a new and improved purse alarm which has all the advantages of the prior art purse alarm apparatus and none of the disadvantages.

To attain this, the present invention provides a parse alarm including a unitary housing mounted within the purse having a heat sensor to activate a latching circuit, whereupon sensing of heat such as by an unauthorized individual within the purse cavity effects actuation of an alarm to direct a tone generator to effect audible alarm through an associated speaker housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily he utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the abstract is to enable the U.S. Patent and Trademark office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved purse alarm which has all the advantages of the prior art purse alarm apparatus and none of the disadvantages.

It is another object of the present invention tn provide a new and improved purse alarm which may be easily and efficiently manufactured and marketed.

It is a further object of the present invention to provide a new and improved purse alarm which is of a durable and reliable construction.

An even further object of the present invention is to provide a new and improved purse alarm which is susceptible of a low cost of manufacture with regard to both materials and labor, and which accordingly is then susceptible of low prices of sale to the consuming public, thereby making such purse alarm apparatus economically available to the buying public.

Still yet another object of the present invention is to provide a new an(i improved purse alarm which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
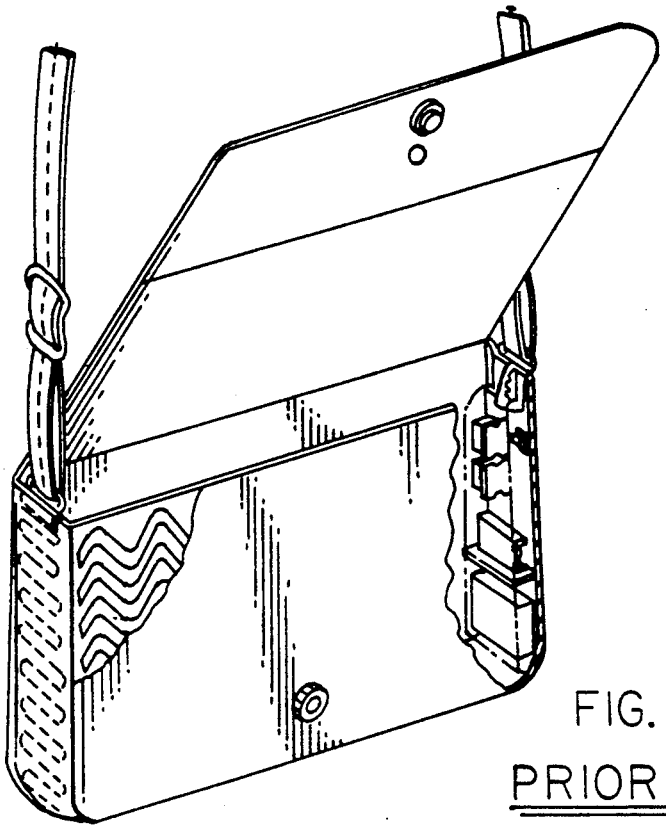
FIG. 1 PRIOR ART
FIG. 1 is an isometric illustration of a prior art purse alarm structure.
Figure 2:
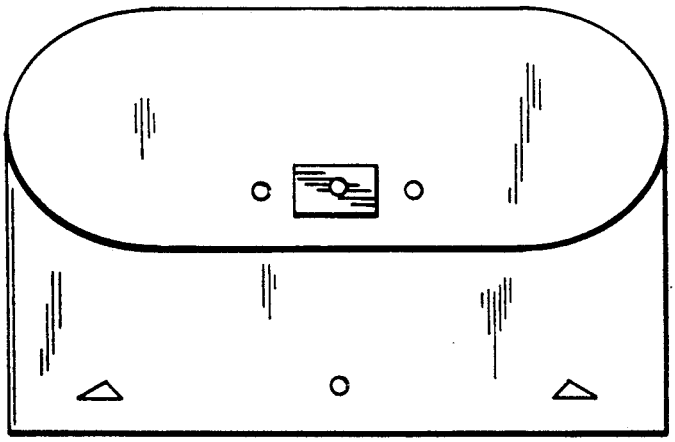
FIG. 2 PRIOR ART
FIG. 2 is an orthographic view of a further prior arm purse alarm.

With reference now to the drawings, and to FIGS. 1 to 7 thereof, a new and improved purse alarm embodying the principles and concepts of the present invention and generally designated by the reference numeral 10 will he described.

Figure 3:
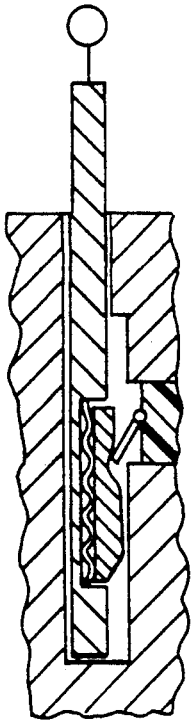
FIG. 3 PRIOR ART
FIG. 3 is an orthographic cross-sectional illustration of the mechanical switching of the first alarm as indicated in FIG. 2.
Figure 4:
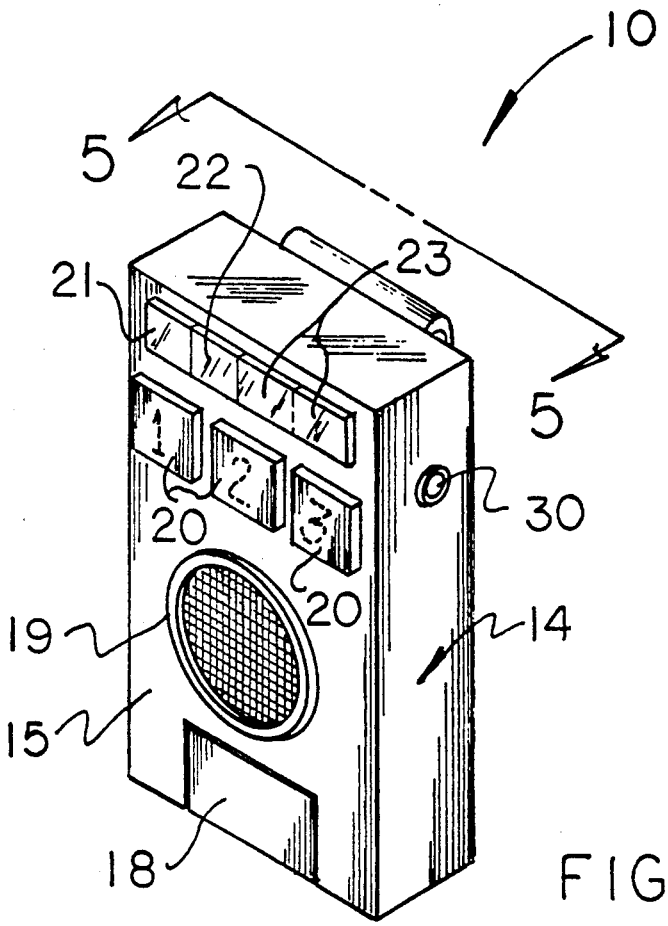
FIG. 4 is an isometric illustration of the alarm housing structure of the invention.
Figure 5:
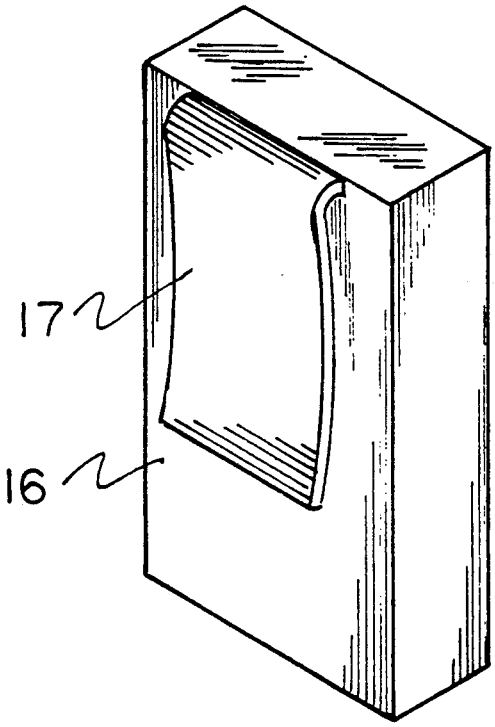
FIG. 5 is an isometric rear view of the alarm housing structure, taken along the lines 5—5 of FIG. 4 in the direction indicated by the arrows.
Figure 6:
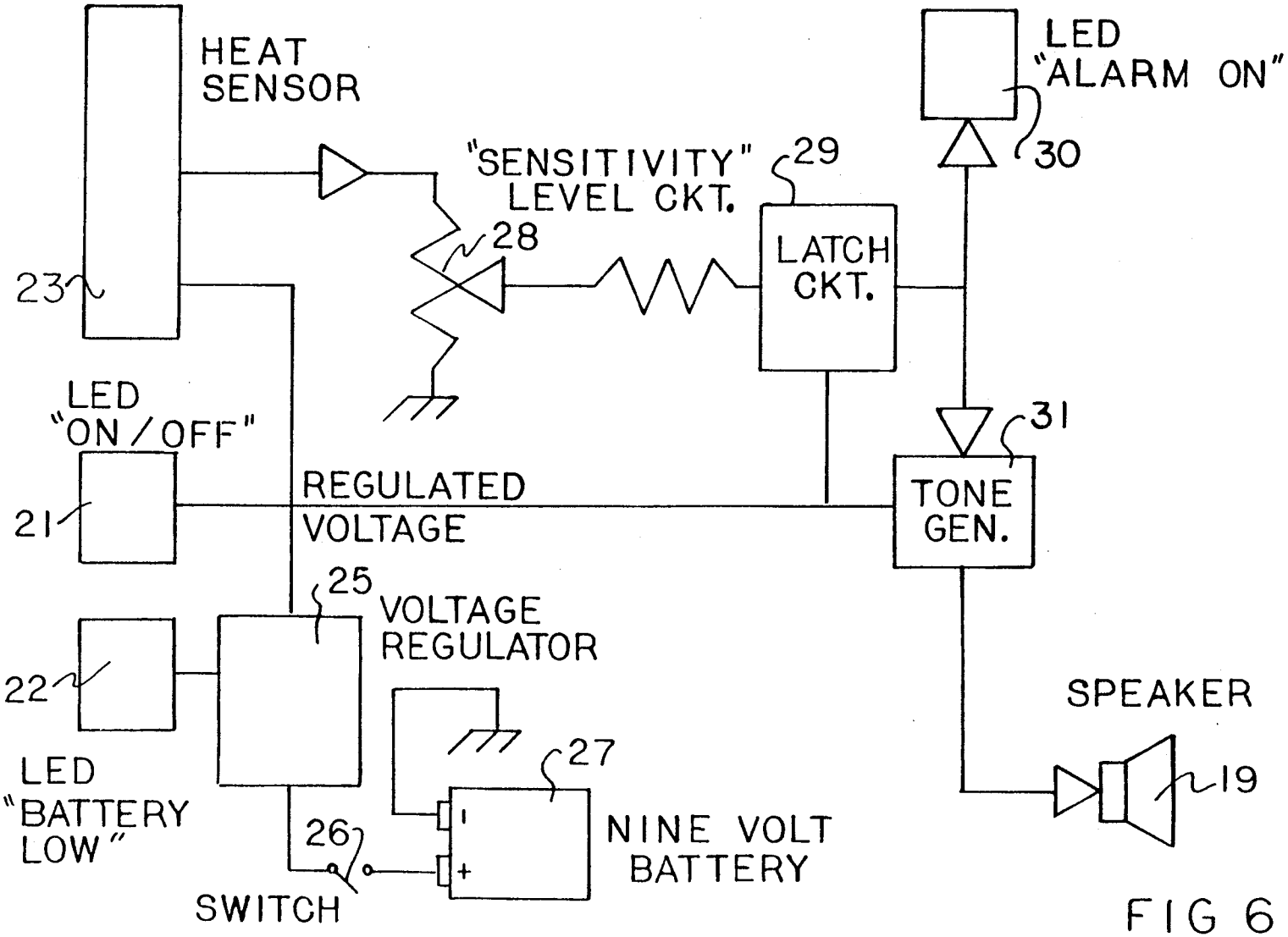
FIG. 6 is a diagrammatic illustration of the circuitry utilized by the invention.
Figure 7:
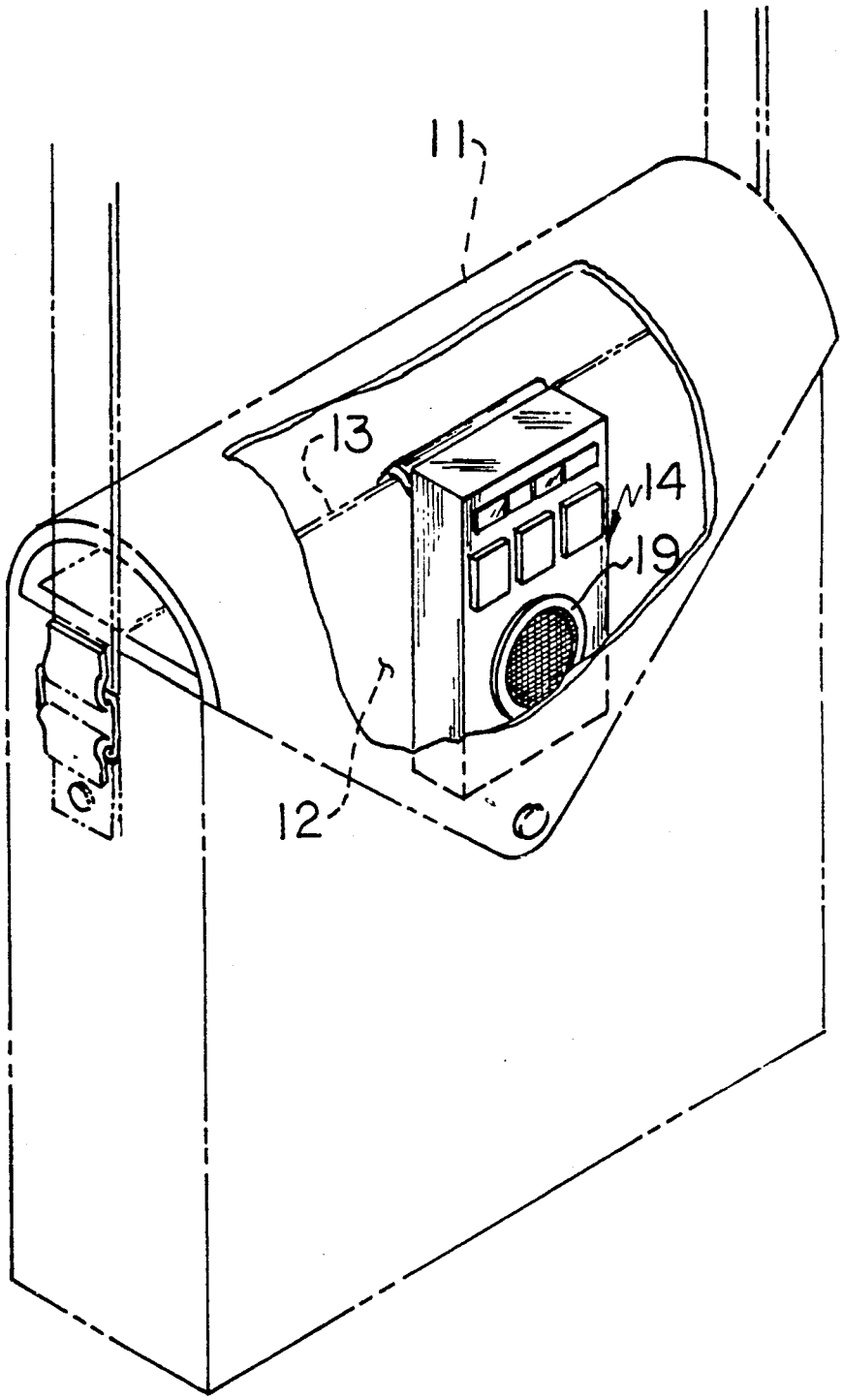
FIG. 7 is an isometric illustration of the alarm structure positioned within an associated purse member.

The FIG. 1 illustrates a prior art purse alarm structure, such as indicated in U.S. Pat. No. 4,885,570, wherein a wavy wire is distributed relative to a purse casing, whereupon engagement by a thief and the like effects actuation of the alarm. The FIGS. 2 and 3 indicate the alarm structure utilized in the U.S. Pat. No. 4,394,644 having a mechanical actuator switch as indicated in FIG. 3, whereupon removal of the purse relative to an owner's body containing portions of the switch, the alarm is actuated.

More specifically, the purse alarm 10 of the instant invention (FIGS. 4–7) essentially comprises an alarm housing 14 positioned within a purse member 11 having a purse cavity 12 and a wall 13 to receive a spring clip 17 mounted to a rear wall 16 of the alarm housing 14. The front wall 15 includes a battery cover 18 removable to have access to a battery 27 for replacement and maintenance thereof. An audible speaker 19 is provided, as are digital code buttons 20 to engage a latch circuitry 29 (sep FIG. 6). A light emitting diode on/off indicator/-switch 21 is provided, as well as a battery low level indicator light 22. A heat sensor 23 is provides in association with an alarm indicator light member 30 mounted to a side wall of the housing for convenience. The FIG. 6 notes the inter-engaging circuitry of the invention, wherein the battery 27 is operative through a voltage regulator 25 having a voltage regulator switch 26 that is engaged upon activation of the latch circuitry 29 that may be disengaged upon directing proper digital code into the code buttons 20. The heat sensor 23 operative through an adjustable selective circuit 28 is operative to effect actuation of the alarm and upon engagement of the on/off switch 21, the regulator voltage is operative through the latch circuitry to direct energy to the tone generator 31 actuating the alarm indicator light 30 simultaneously with the audible speaker 19 to indicate intrusion into the purse cavity of an unauthorized individual.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A purse alarm, the purse alarm including an alarm housing having a front wall and rear wall, and at least one side wall, wherein the rear wall includes a spring clip arranged for securement of the housing within a purse member, and the front wall includes a battery cover, and the housing includes a battery contained therewithin, and an audible speaker directed through the front wall, wherein the front wall further includes an on/off indicator/switch, and digital code entry buttons, and the housing includes a voltage regulator contained therewithin operatively associated with the battery, wherein the voltage regulator includes a voltage regulator switch responsive to said digital code entry buttons to engage the battery upon actuation of the voltage regulator, and a heat sensor mounted to the front wall, wherein the heat sensor is operative through a heat sensor adjusting circuit, and a latch circuit in operative communication with the heat sensor adjusting circuit and the audible speaker, the latch circuit being arranged to disengage responsive to said digital code entry buttons, and a tone generator in electrical communication with the latch circuit and the voltage regulator, wherein the tone generator includes electrical communication with the speaker, and an alarm indicator light mounted to the at least one side wall of the housing, whereby actuation of the tone generator effects simultaneous actuation of the speaker and the alarm indicator light.

* * * * *